US005673504A

United States Patent [19]

Brown

[11] Patent Number: 5,673,504

[45] Date of Patent: Oct. 7, 1997

[54] TAPE DISPLAY DEVICE

[75] Inventor: Frank Charles Brown, Spotswood, Australia

[73] Assignee: Able Industries Pty. Ltd., Spotswood, Australia

[21] Appl. No.: 343,524

[22] PCT Filed: Sep. 24, 1993

[86] PCT No.: PCT/AU93/00492

§ 371 Date: Jun. 13, 1995

§ 102(e) Date: Jun. 13, 1995

[87] PCT Pub. No.: WO94/20945

PCT Pub. Date: Sep. 15, 1994

[30] Foreign Application Priority Data

Mar. 9, 1993 [AU] Australia ..... PL7724

[51] Int. Cl.[6] ..... G09F 11/18

[52] U.S. Cl. ..... 40/518; 40/471

[58] Field of Search ..... 40/522, 471, 518

[56] References Cited

U.S. PATENT DOCUMENTS

| | | | |
|---|---|---|---|
| 664,692 | 12/1900 | Tropp | 40/522 X |
| 825,195 | 7/1906 | Daniels | 40/522 X |
| 1,902,884 | 3/1933 | Wagner | 40/522 |
| 1,945,571 | 2/1934 | Samaras | 40/522 X |
| 2,252,805 | 8/1941 | Gruden | 40/522 |
| 2,859,656 | 11/1958 | Lemieux | 40/471 X |
| 4,203,234 | 5/1980 | Thenon | 40/522 X |
| 4,842,215 | 6/1989 | Takami . | |
| 5,003,717 | 4/1991 | Trame et al. | 40/518 |
| 5,088,219 | 2/1992 | Toraby-Payhan | 40/518 X |

FOREIGN PATENT DOCUMENTS 2623929 12/1987 France .

*Primary Examiner*—Joanne Silbermann
*Attorney, Agent, or Firm*—Sheridan Ross P.C.

[57] ABSTRACT

A tape display device comprises a housing supporting a pair of parallel rollers between which a tape is adapted to be wound back and forth to display different visual information contained on the tape. The rollers are driven by a continuous belt via an electric motor. One of the rollers is a tension roller which maintains tension in the tape as it is wound back and forth between the rollers. The tension roller consists of a cylinder having end caps for providing bearing surfaces which bear on respective bushes in the housing to provide rotational mounting of the roller. A drive pinion on the outside of the housing has a stub-axle which extends through the bush and end cap and into the cylinder. A spiral tension spring is attached between the end of the stub-axle and a flange of the end cap. The spring is located within the cylinder and allows relative movement between the cylinder and pinion and maintains tension in the tape as the two rollers rotate in synchronism and the diameter of the tape on each roller varies.

14 Claims, 4 Drawing Sheets

TAPE DISPLAY DEVICE

This invention relates to a display device and more particularly to a display device having a tape or web containing display information, which tape or web is stretched between two parallel rollers on which the tape is wound, whereby winding of the tape back and forth between the two rollers enables different information to be displayed. The device has particular utility in automatic display of petroleum prices at service stations where frequent price changes dictate the need for a device where the price can be changed quickly and conveniently.

Display devices of the general kind in question are known and one such device is described in European patent 0253033 in the name World Acrilux S.A.. Another such device is described in Australian Patent No. 596,441 in the name of Milwaukee Sign Company. Both these earlier patents are directed to the tape or web rollers and means for differentially rotating the rollers to compensate for the changing diameters of the rollers as the tape is wound from one roller to the other. The device disclosed in the Milwaukee Sign Company patent used clutches to engage and disengage drive means from the respective rollers and a differential brake to maintain tension in the tape. The mechanism is relatively complex and hence costly to produce.

The device disclosed in the World Acrilux S.A. patent provides permanently engaged drive means for rotating the two rollers simultaneously and one of the rollers is connected to the drive means by a spiral spring; the action of which compensates for the variation in diameter between the respective rollers and maintains substantially constant tension in the tape. The device is a single digit device and in order to display petroleum prices it is necessary to arrange a number of such devices in juxtaposition. Since the spiral spring is arranged in a pulley housing external of a frame of the device, close spacing of several devices is prevented and this is a disadvantage of this known device. Furthermore, the stainless steel shafts which carry the rollers are costly and are also relatively heavy and both these factors contribute disadvantages to the known device.

Accordingly it is an object of this invention to provide improvements in a display device of the kind in which a tape is wound back and forth between two spaced parallel rollers to establish a new display position of the tape.

Thus, the invention provides a tension roller for a tape display device for maintaining tension in the tape as the tape is wound between said roller and a further roller spaced from the tension roller, said rollers being mounted within a framework with their axes mutually parallel, said tension roller comprising a cylinder on which the tape is wound and an axial drive pinion arranged externally of said cylinder at one end thereof, said drive pinion and said cylinder being connected by a spring to facilitate relative movement therebetween, characterized in that, said pinion has a stub-axle extending centrally within said one end of said cylinder a short distance and said spring is arranged within said cylinder and is connected between said stub-axle and by the other end to said cylinder to facilitate said relative movement therebetween.

Another form of the invention provides a tape display device comprising a tape which carries a succession of visual information and extends between two spaced parallel rollers on which the tape is wound, said rollers being mounted in a framework and being spaced sufficient to allow an item of said visual information to be displayed on a portion of tape extending between said rollers, a drive pinion or pulley on the end of each roller and a drive chain or belt driven by a motor and cooperating with said pinions or pulleys to drive said rollers, one of said rollers being a tension roller having a spiral spring between the pinion or pulley and the roller for maintaining tension in the tape as the tape is wound between said rollers, characterized in that, said drive pinion or pulley of said tension roller has a stub-axle extending centrally within the end of said cylinder a short distance and said spiral spring is arranged within said cylinder and is connected between said stub-axle and the inside of said cylinder to facilitate relative movement therebetween and maintain said tension in the tape, and said cylinder has end portions which bear on respective bushes in said framework to provide bearings on which said cylinder rotates.

In order that the invention may be more readily understood one particular embodiment will now be described with reference to the accompanying drawings wherein.

Figure 1:
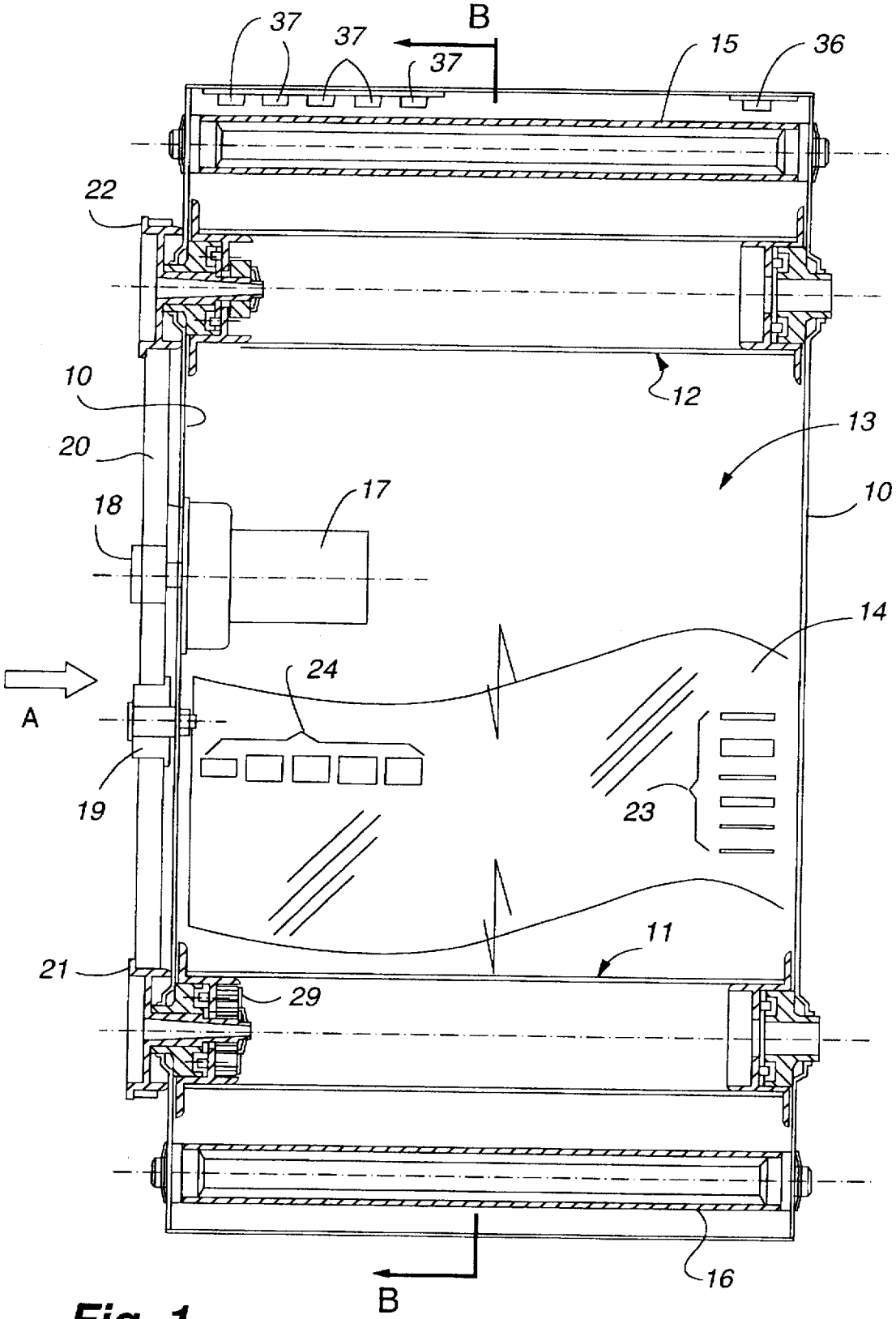
FIG. 1 is a sectional front elevation of a tape display device incorporating the invention.
Figure 2:
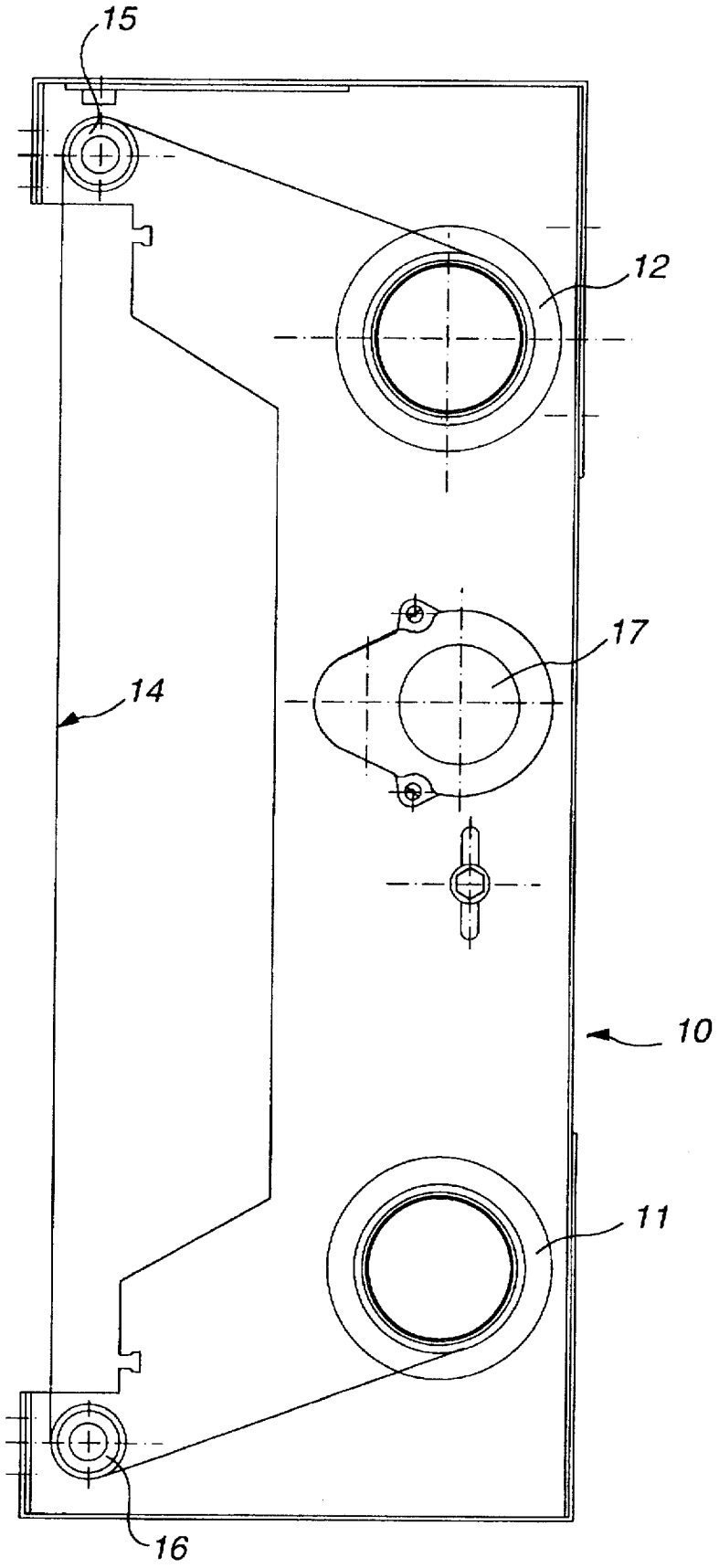
FIG. 2 is a section along the line B—B of FIG. 1.
Figure 3:
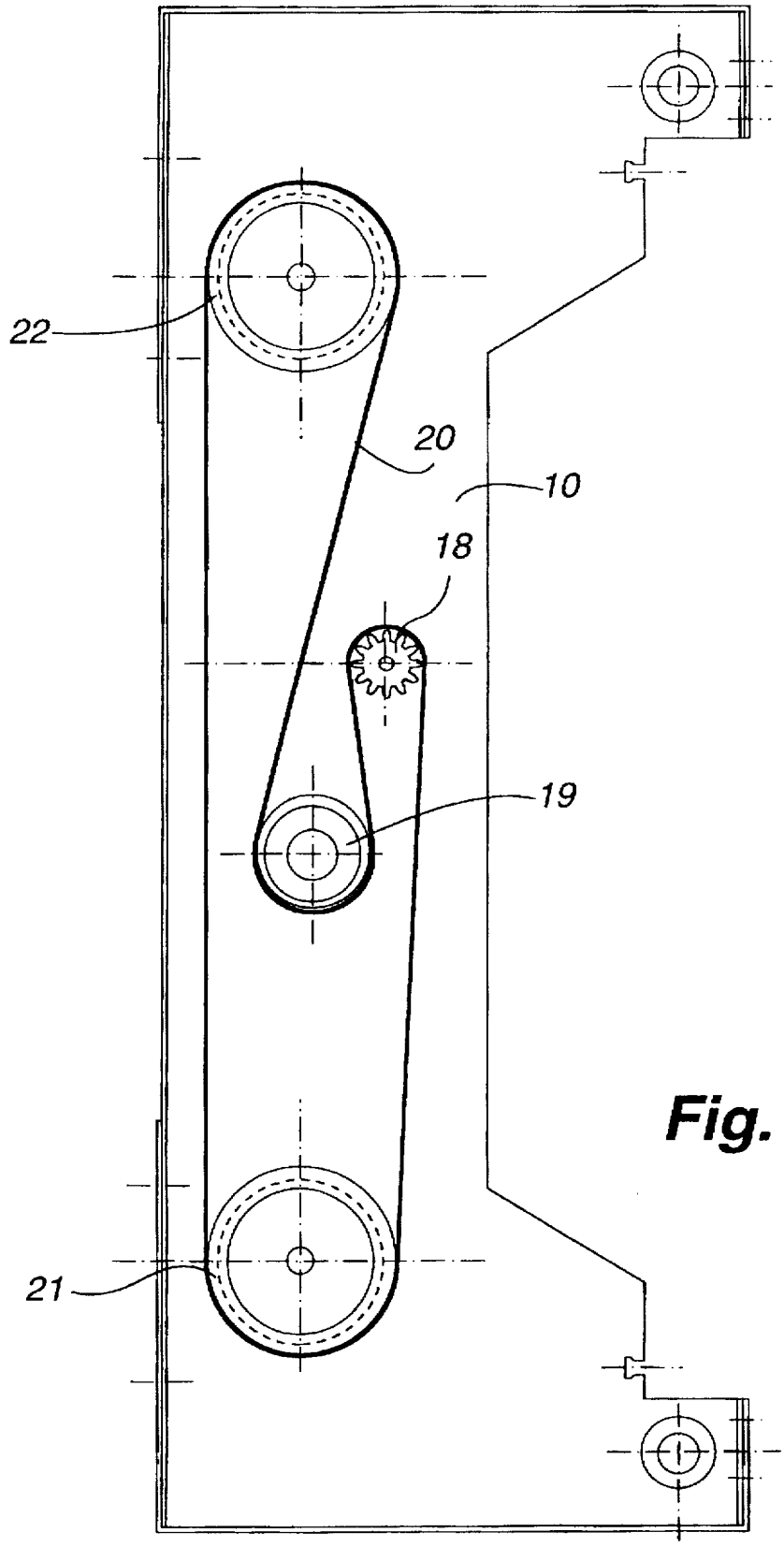
FIG. 3 is a side elevation in the direction of arrow A in FIG. 1 with tape omitted.

The tape display device is shown to comprise a housing 10 which supports spaced parallel milers 11 and 12 which extend between opposed sides of the housing 10 and are contained therein. The roller 11 is a tension roller and the roller 12 is a drive roller as will become apparent hereinbelow. The housing 10 has an open front face 13 across which a tape 14 passes in its travel back and forth between the rollers 11 and 12. The type 14 is only partly shown in FIG. 1 and passes over idler rollers 15 and 16 which are arranged between the tension roller 11 and the drive roller 12 in the path of the tape 14. The path of the tape 14 is more evident in FIG. 2.

An electric motor 17 is mounted within the housing 10 on one side and has a drive gear 18 mounted on the motor shaft on the outside of the housing. A belt tensioning pulley 19 is mounted on the outside of the housing adjacent the drive gear 18 and a drive belt 20 extends over the drive gear 18, pulley 19 and pinions 21 and 22 of the tension roller 11 and drive roller 12, respectively. Thus, rotation of the motor causes the belt 20 to drive the pinions 21 and 22 in synchronism and the motor 20 is reversible whereby the pinions may be driven in either direction. The tape 14 contains visual information (not shown) for display purposes and in the case where the device is used to display petroleum prices, the display comprises the numbers 0 to 9 inclusive sequentially on the tape. Also appearing on the tape 14 is bar code information 23 or other coded data 24 which can be read electronically by bar code reader 36 or electronic sensors 37 as the case may be to provide precise information as to the position of the tape whereby the motor 17 may be activated to step the tape from one position to another via the drive belt 20.

Figure 4:
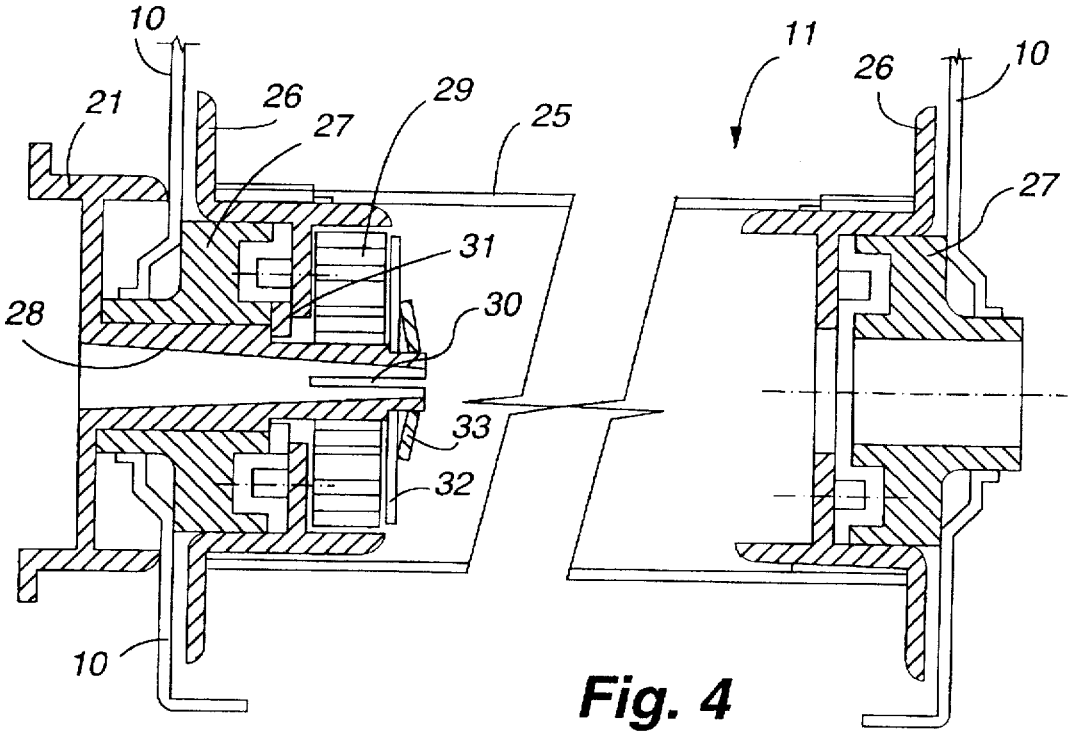
FIG. 4 is a sectional view on an enlarged scale of the tension roller of the device of FIGS. 1–3.

Referring now to FIG. 4, there is shown on an enlarged scale a sectional view of the tension roller 11. The roller 11 consists of a cylinder 25 on which the tape is wound and which has end caps 26 inserted in the respective ends thereof. The end caps 26 provide a bearing surface which bears on respective bushes 27 located in suitable apertures in the sides of housing 10, respectively. The pinion 21 is a drive pinion gear having a stub-axle 28 which extends through a central aperture of bush 27 and past a flange of the end cap 26 to the inside of the cylinder 25. The stub-axle 28 is formed integral with the drive gear of the pinion 21.

A tension spring 29 in the form of a spiral spring in located adjacent the end of stub-axle 28 and extends from the stub-axle out to the end cap 26. The spring 29 is connected to the stub-axle via slot 30 and at the other end is connected to end cap 26 by insertion in a suitable locating slot (not shown). A spacer washer 31 is provided between the flange of the end cap 26 and the bush 27 and a keeper washer fits over the end of stub-axle 28 and is retained thereon by retaining clip 33 which retains all the components in position.

At the other end of the tension roller 11 the end cap 26 bears on the bush 27 in the same manner and is rotatable thereon when the cylinder 25 is rotated to move the tape 14.

As will be evident rotation of the drive pinion 21 by means of drive belt 20 causes the stub-axle and consequently the tension spring 29 to be rotated which then causes the tension roller 11, that is, the cylinder 25 to also be rotated. Of course the tension spring 29 allows differential rotation between the pinion 21 and the cylinder 25 whereby substantially constant tension is maintained on the tape 14 despite the fact that the tape will almost always have a different diameter on each roll depending upon how much tape is wound on one roll as compared to the other. Adjustment is necessary during assembly of the apparatus to ensure that the maximum extent of the tension spring 29 is not exceeded when the tape is wound completely off one of the rollers 11 or 12 and on to the other.

Figure 5:
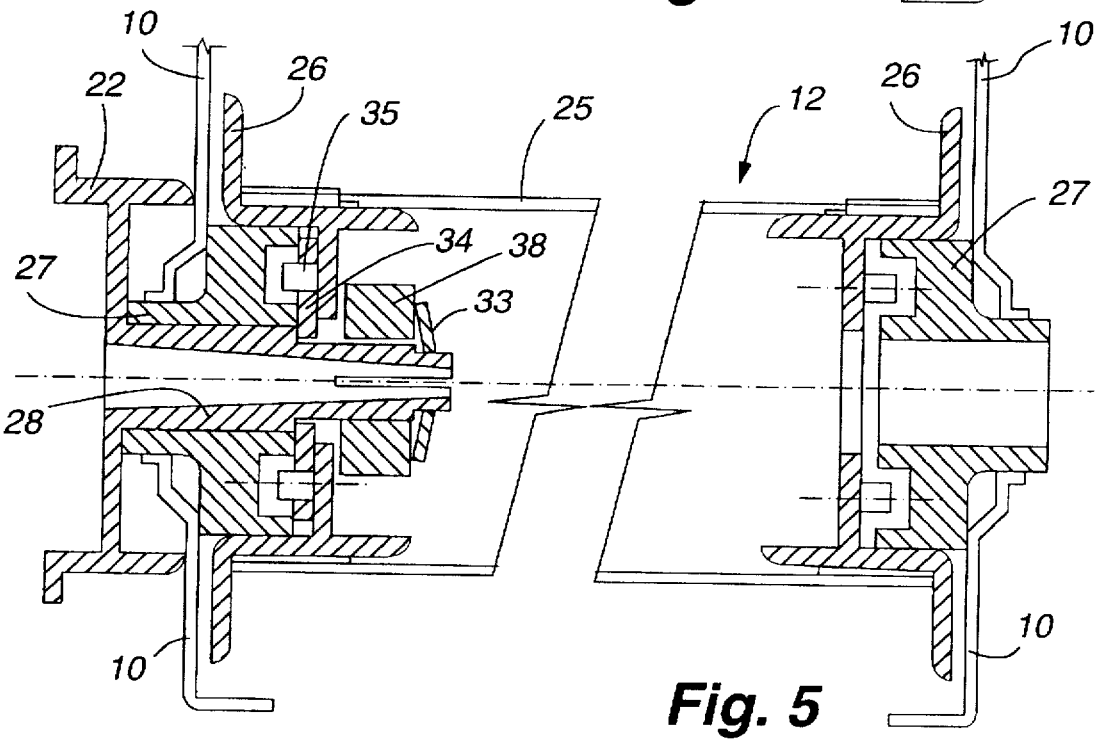
FIG. 5 is similar to FIG. 4 but shows the drive roller of the device according to FIGS. 1–3.

In FIG. 5 there is shown in detail the drive roller 12 which is essentially the same as the tension roller 11 except that there is no tension spring providing a differential drive between the pinion 22 and the cylinder 25. A spacer 38 takes the place of the tension spring 29. Like components have the same reference numerals as between FIGS. 4 and 5, The essential difference is that the drive roller 12 of FIG. 5 has a drive plate 34 connected between the stub-axle 28 and the end cap 26. The drive plate 24 is connected to a flange of the end cap 26 by projections 35 on the flange of the end cap 26 which engage in spaced circumferential holes in the drive plate 34. In other words the pinion 22 is rotationally locked to the cylinder 25 so as to rotate therewith. The main components making up the rollers 11 and 12 are the same at each end of each roller and in each of the two rollers to reduce the number of different components.

It should be evident to persons skilled in the art that the provision of a tension roller 11 and drive roller 12 which do not have a central stainless steel axle, means that the assembly is much lighter and less expensive to manufacture. Furthermore, the location of the tension spring mechanism inside the tension roller 11 rather than externally of the housing 10 provides a much more compact overall design. This means that the width of the pinion 21 which is outside the housing 10 may be reduced thereby enabling adjacent tape display devices to be arranged in much closer proximity. This can have considerable advantages when a number of such devices are arranged in juxtaposition to provide pricing information.

In addition to the above the housing 10 is manufactured from clear plastics material which is moulded to the desired shape and this enables artificial lighting (not shown) to be located behind the device whereby information displayed on the tape 14 is readily visible at night. It also results in an extremely lightweight device.

Clearly, the invention may take other forms to that shown in the specific embodiment described above. The shape and arrangement of the components may differ considerably and it is only important that the tension spring mechanism be located inside the housing 10 and that the tension roller 11 and drive roller 12 be designed so as not to require a central axle.

I claim:

1. A tape display device comprising:

a single drive means;

tape to be displayed;

a pair of spaced apart rollers between which said tape to be displayed is wound, wherein each of said spaced apart rollers is positively driven by said single drive means;

wherein one of said rollers provides tension in said tape, said tensioned roller comprising a hollow cylinder on which the tape is wound, said hollow cylinder having a first end and a second end; and an axial drive pinion connected to said hollow cylinder by a spiral spring to facilitate differential movement between said rollers as the respective diameters of the rollers change due to tape transfer from one roller to the other roller;

wherein said axial drive pinion comprises a stub-axle partially extending into said first end of said cylinder such that said spring is arranged within said cylinder and is connected between said stub-axle and said cylinder.

2. A tape display device according to claim 1 further comprising a bush at said first end of said hollow cylinder for providing bearing surfaces on which both said stub-axle and said cylinder are able to rotate.

3. A tape display device according to claim 1 further comprising a bush at the second end of said hollow cylinder for providing a bearing surface on which said cylinder is able to rotate.

4. A tape display device according to claim 1 further comprising end caps positioned at said first end and said second end of the hollow cylinder.

5. A tape display device comprising a tape which carries a succession of visual information and extends between two spaced parallel rollers on which the tape is wound, said rollers being mounted in a framework and being spaced sufficient to allow an item of said visual information to be displayed on a portion of tape extending between said rollers, a drive pinion or pulley on the end of each roller and a drive chain or belt driven by a motor where each of said rollers is positively driven by said motor, one of said rollers being a tension roller having a spiral spring between the pinion or pulley and the roller for maintaining tension in the tape as the tape is wound between said rollers, characterized in that, said drive pinion or pulley of said tension roller has a stub-axle extending centrally within the end of said cylinder a short distance and said spiral spring is arranged within said cylinder and is connected between said stub-axle and the inside of said cylinder to facilitate relative movement therebetween and maintain said tension in the tape, and said cylinder has end portions which bear on respective bushes in said framework to provide bearings on which said cylinder rotates.

6. A tape display device according to claim 5, wherein the other said roller is of similar construction to said tension roller with the exclusion of said spiral spring and said stub-axle is rotationally locked to the cylinder so as to rotate therewith.

7. A tape display device according to claim 5, wherein said framework comprises a housing manufactured from clear plastics material whereby artificial lighting located behind said device is able to illuminate the visual information at night.

8. A tape display device according to claim 5, characterized in that, said cylinders include end caps at each end thereof, said end caps being secured to rotate with the respective cylinder and each having a cylindrical recess co-axial with the respective cylinder and providing a said end portion in the form of a bearing surface which bears on a respective bush.

9. A tape display device for displaying one or more images on a tape comprising:

a motor;

a housing;

a first roller, positioned within said housing and capable of rotating about a first axis, wherein said first roller has a first end and a first opening at said first end;

a second roller spaced apart from said first roller within said housing and capable of rotating about a second axis which is substantially parallel to said first axis; and illumination means positioned between said first roller and said second roller for illuminating an image on a tape;

a first axial drive pinion capable of rotating about said first axis, said axial drive pinion comprising a stub-axle which partially extends into said first opening of said first roller;

a second axial drive pinion capable of rotating about said second axis and connected to said second roller such that the rotation of said second axial drive pinion causes said second roller to rotate; and a spring having a first end connected to said stub-axle and a second end connected to said first roller such that the rotation of said first axial drive pinion causes said first roller to rotate;

wherein said first axial drive pinion and said second axial drive pinion are connected to said motor such that said motor is capable of rotating said first axial drive pinion and said second axial drive pinion.

10. A tape display device according to claim 9, wherein:

said spring comprises coils which spiral away from said first axis.

11. A tape display device according to claim 9, wherein:

said axial drive pinion is substantially positioned outside said housing;

said stub-axle extends through an opening in said housing.

12. A tape display device according to claim 9, further comprising:

a bush at said first end of said first roller for providing a bearing surface on which said stub-axle and said first roller are able to rotate.

13. A tape display device according to claim 12, wherein:

said bush is fixed in said housing;

said axial drive pinion is positioned outside said housing; and said stub-axle extends through an opening in said housing and an opening in said bush.

14. A tape display device according to claim 12, further comprising:

an end cap positioned at said first end of said first roller, said end cap providing a bearing surface for said first end of said first roller.

* * * * *